US007186320B1

(12) United States Patent
Staerzl et al.

(10) Patent No.: US 7,186,320 B1
(45) Date of Patent: Mar. 6, 2007

(54) SUBMERSIBLE ANODE MADE OF A RESIN MATRIX WITH A CONDUCTIVE POWDER SUPPORTED THEREIN

(75) Inventors: Richard E. Staerzl, Fond du Lac, WI (US); Christopher J. Misorski, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 545 days.

(21) Appl. No.: 10/632,056

(22) Filed: Jul. 31, 2003

(51) Int. Cl.
*C23F 3/10* (2006.01)
*C23F 3/12* (2006.01)
*C23F 3/08* (2006.01)
*C23F 3/16* (2006.01)

(52) U.S. Cl. ..... 204/196.18; 204/196.19; 204/196.37; 204/280

(58) Field of Classification Search ..... 204/280, 204/196.37, 196.18, 196.19; 205/729, 740
See application file for complete search history.

(56) References Cited

U.S. PATENT DOCUMENTS 3,953,742 A 4/1976 Anderson et al. ..... 307/95
4,322,633 A 3/1982 Staerzl ..... 307/95
4,492,877 A 1/1985 Staerzl ..... 307/95
4,528,460 A 7/1985 Staerzl ..... 307/95
6,183,625 B1 2/2001 Staerzl ..... 205/727
6,251,308 B1 6/2001 Butler ..... 252/511
6,365,069 B2 4/2002 Butler et al. ..... 252/511
7,015,861 B2 * 3/2006 Boyd et al. ..... 343/700 MS
2004/0231975 A1 * 11/2004 Boyd et al. ..... 204/196.18

* cited by examiner

*Primary Examiner*—Bruce F. Bell
(74) *Attorney, Agent, or Firm*—William D. Lanyi

(57) ABSTRACT

An anode for a cathodic protection system comprises a base portion or support structure which is shaped to receive a conductive element, or insert, within a cavity of the support structure. The conductive element is made of a polymer material, such as vinyl ester, with a conductive filler, such as graphite powder. The base is attachable to a marine vessel or other submersible component that is being protected by a cathodic protection system. The anode allows the use of a relatively inexpensive resin material with a graphite filler in place of a much more expensive platinum coated titanium element.

12 Claims, 2 Drawing Sheets

SUBMERSIBLE ANODE MADE OF A RESIN MATRIX WITH A CONDUCTIVE POWDER SUPPORTED THEREIN

BACKGROUND OF THE INVENTION

1. Field of the Invention

The present invention generally relates to anode used in a marine environment and, more particularly, to an anode which is made of a polymer material, such as vinyl ester, that is impregnated with conductive particles, such as graphite powder.

2. Description of the Prior Art

It is well known that submersible components can suffer corrosion degradation as a result of galvanic currents between dissimilar metals. This type of galvanic corrosion can severely damage marine components, such as drive units. As an example, since the propeller of a marine propulsion system and the submerged housing of that same system are often made of dissimilar metals, a galvanic reaction can easily occur. This can result in severe damage to the marine drive unit.

U.S. Pat. No. 4,322,633, which issued to Staerzl on Mar. 30, 1982, discloses a marine cathodic protection system. The system maintains a submerged portion of a marine drive unit at a selected potential to reduce or eliminate corrosion thereto. An anode is energized to maintain the drive unit at a preselected constant potential in response to the sensed potential at a closely located reference electrode during normal operations. Excessive current to the anode is sensed to provide a maximum current limitation. An integrated circuit employs a highly regulated voltage source to establish precise control of the anode energization.

U.S. Pat. No. 4,528,460, which issued to Staerzl on Jul. 9, 1985, discloses a cathodic protection controller. A control system for cathodically protecting an outboard drive unit from corrosion includes an anode and a reference electrode mounted on the drive unit. Current supplied to the anode is controlled by a transistor, which in turn is controlled by an amplifier. The amplifier is biased to maintain a relatively constant potential on the drive unit when operated in either fresh or salt water.

U.S. Pat. No. 4,492,877, which issued to Staerzl on Jan. 8, 1985, discloses an electrode apparatus for cathodic protection. The apparatus is provided for mounting an anode and reference electrode of a cathodic protection system on an outboard drive unit. The apparatus includes an insulating housing on which the anode and reference electrode are mounted and a copper shield mounted between the anode and the electrode to allow them to be mounted in close proximity to each other. The shield is electrically connected to the device to be protected and serves to match the electrical field potential at the reference electrode to that of a point on the outboard drive unit remote from the housing.

U.S. Pat. No. 6,183,625, which issued to Staerzl on Feb. 6, 2001, discloses a marine galvanic protection monitor. The system uses to annunciators, such as light emitting diodes, to alert a boat operator of the current status of the boat's galvanic protection system. A reference electrode is used to monitor the voltage potential at a location in the water and near the component to be protected. The voltage potential of the electrode is compared to upper and lower limits to determine if the actual sensed voltage potential is above the lower limit and below the upper limit. The two annunciator lights are used to inform the operator if the protection is proper or if the components to be protected is either being over protected or under protected.

U.S. Pat. No. 3,953,742, which issued to Anderson et al on Apr. 27, 1976, discloses a cathodic protection monitoring apparatus for a marine propulsion device. The system monitor is coupled to an impressed current cathodic protection circuit used for corrosion protection circuit used for corrosion protection of a submerged marine drive. The cathodic protection circuit includes one or more anodes and a reference electrode mounted below the water line and connected to an automatic controller for supplying an anode current which is regulated in order to maintain a predetermined reference potential on the protected structure. A switch selectively connects a light emitting diode lamp or other light source between the controller output and ground so that the controller may, when tested, be used to operate the light source in order to confirm that power is available to the anode.

U.S. Pat. No. 6,251,308, which issued to Butler on Jun. 26, 2001, describes a highly conductive molding compound and fuel cell bipolar plates comprising the compounds. A conductive polymer is disclosed which is suitable for use in applications which require corrosion resistance including resistance to corrosion when subjected to acidic flow at temperatures ranging from −40 degrees Fahrenheit to 140 degrees Fahrenheit and which can be molded into highly intricate and thin specimens which exhibit consistent conductivity, sufficient strength and flexibility, and appropriate surface characteristics. In particular the invention involves molding unsaturated prepolymer resin composition which have high loadings of conductive fillers. Further to enable the necessary characteristics, the composition includes rheological modifies such as Group II oxides and hydroxides; carbodiamides; aziridines; polyisocyanates; polytetrafluroetheryle (PTFE); perfluoropolyether (PFPE), and polyethylene. Ostensibly, these modifiers act to alter the apparent molecular weight and three dimensional prepolymer network structures correcting rheological deficiencies which otherwise lead to excessive resin particulate separation during the molding process and large variances in bulk conductivity across the plate surface. The composition is disclosed for use in electrochemical cells, such as fuel cells.

U.S. Pat. No. 6,365,069, which issued to Butler et al on Apr. 2, 2002, describes a process of injection molding highly conductive molding compounds and an apparatus for this process. A technique and apparatus are disclosed for injection molding highly filled conductive resign compositions. These compositions include one or more unsaturated polyester and vinyl ester resin; a copolymer having a terminal ethylene group; and at least about 50 weight percent of an inorganic particulate conductive filler, an initiator, and a rheological modifier to prevent phase separation between the resin and the conductive filler during molding. The method allows these compositions to be molded into highly intricate and thin electrically and thermally conductive specimens without significant post process machining. The method involves the use of an injection molding apparatus that has a hopper with an auger having a vertical component in its positioning to feed into the feed throat of an injection molding machine which has a phenolic screw that has been modified to have a constant inner diameter and a constant flight depth.

The patents described above are hereby expressly incorporated by reference in the description of the present invention.

The material described in U.S. Pat. Nos. 6,251,308 and 6,365,069 have been used in certain devices, such as fuel cells. The high electrical conductivity of the material and its resistance to corrosive elements allows it to be used as a conductive material in certain environments that would otherwise attack many other types of material. The material is available in commercial quantities from Quantum Composites, Inc. which is a subsidiary of Premix, Inc. One such material is referred to as "Pemtex".

Marine anodes have been made from expensive materials, such as platinum and titanium, in order to provide a useful life when they are submerged for use as an anode in a cathodic protection system. It would be useful if a marine anode could be made of a less expensive material that can withstand rough treatment in a corrosive environment.

SUMMARY OF THE INVENTION

A submersible anode, made in accordance with a preferred embodiment of the present invention, comprises a support structure with a conductive element comprising a polymer-based matrix material and conductive particles supported within the matrix material. It further comprises a conductor connected in electrical communication with a conductive element, the conductor being connectable to an electrical power supply. The conductive element comprises a matrix of vinyl ester with graphite particles disposed within the matrix in a particularly preferred embodiment of the present invention. The support structure is attachable to a component of a marine vessel and shaped to contain the conductive element. The component of the marine vessel, in a preferred embodiment, is the transom of the marine vessel. The support structure is a polymer in a preferred embodiment and, in certain embodiments, the present invention further comprises a sealing material disposed proximate the conductive element to prevent moisture to from contacting the conductor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
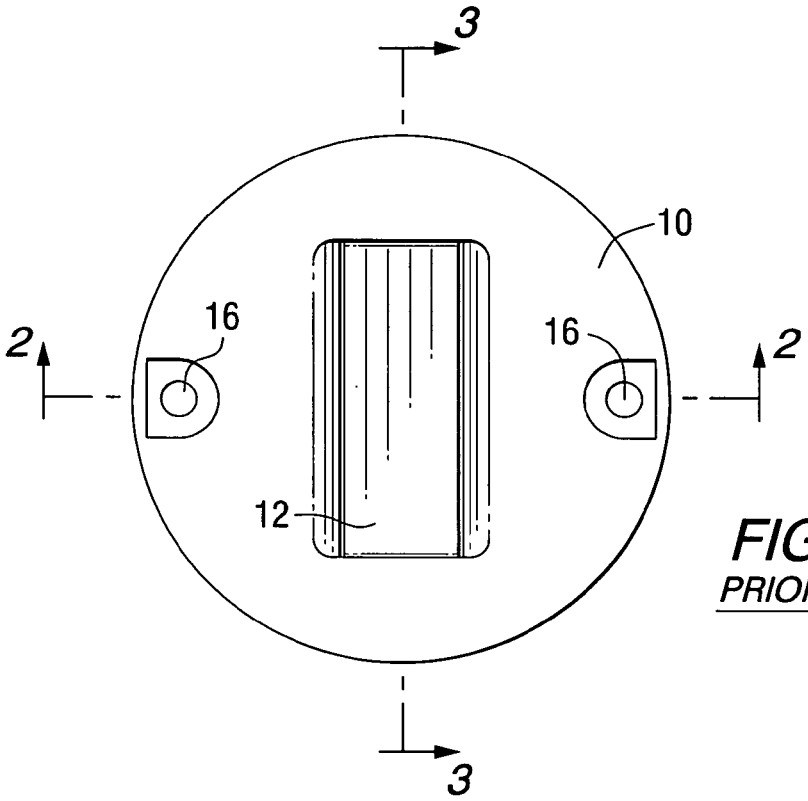
FIG. 1 PRIOR ART
FIGS. 1–3 show prior art anodes used in conjunction with cathodic protection systems of the impressed current type.

Throughout the description of the preferred embodiment of the present invention, like components will be identified by like reference numerals.

A system known to those skilled in the art as the MerCathode system is commercially available from Mercury Marine, a division of Brunswick Corporation. The MerCathode system provides automatic protection against galvanic corrosion. It is a solid state device that operates with a marine vessel's 12-volt battery and provides protection by impressing a reverse blocking current that stops the destructive flow of galvanic currents. It is particularly useful on marine vessels that have stainless steel propellers or other submerged stainless steel hardware. One important element of the MerCathode system, or any other impressed current cathodic protection system, is the anode. In order to increase the useful life of the anode, it is typically manufactured with a titanium element that is coated with platinum. This material is costly and easily damaged by abrasion.

FIG. 1 shows an anode that is well known to those skilled in the art and is typically incorporated as part of the MerCathode system. It has a plastic base 10 which is shaped to support a platinum-coated titanium insert 12. Two holes, 16 are provided to allow the base 10 to be attached to a transom of a marine vessel, or other component, so that it can hold the insert 12 at a preselected position, relative to a device to be protected, under the surface of water in which the marine vessel is operated.

Figure 2:
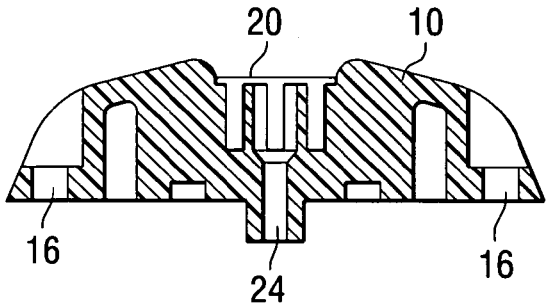
FIG. 2 PRIOR ART

FIG. 2 is a section view of the device shown in FIG. 1. As can be seen, the holes 16 are formed through the base 10. In addition, the base 10 is shaped to have a recess 20 formed in it which is sized to receive the insert 12. In FIG. 2, the insert 12 shown in FIG. 1 is not present. An opening 24 is formed through the base 10 to allow an electrical conductor to pass therethrough, as will be described in greater detail below.

Figure 3:
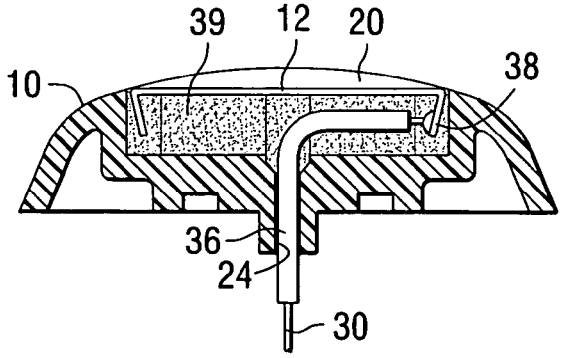
FIG. 3 PRIOR ART

FIG. 3 is a section view of FIG. 1. The insert 12 is shown disposed within the recess 20 of the base 10. An electrical conductor 30, such as a wire, extends through the opening 24. The electrical conductor is shown with an insulative sheath 36 surrounding it, except for an end portion of the conductor 30 itself which is physically and electrically connected to a portion 38 of the insert 12. An encapsulant 39 is disposed around the sheath 36 of the electrical conductor 30 and in the space of the cavity 20 below the insert 12.

The anode shown in FIGS. 1–3 works in a satisfactory manner to provide an important component that is necessary to the galvanic protection system by impressing a current in the water near a device to be protected, such as a stern drive unit. However, in order to provide an anode having a long useful life, expensive components are normally required. The insert 12 is typically made of a titanium element that is coated with platinum. It would therefore be significantly beneficial if the reliability and long life of a MerCathode anode, such as that illustrated in FIGS. 1–3, could be provided at less expense than is required when a platinum-coated titanium element 12 is used.

Figure 4:
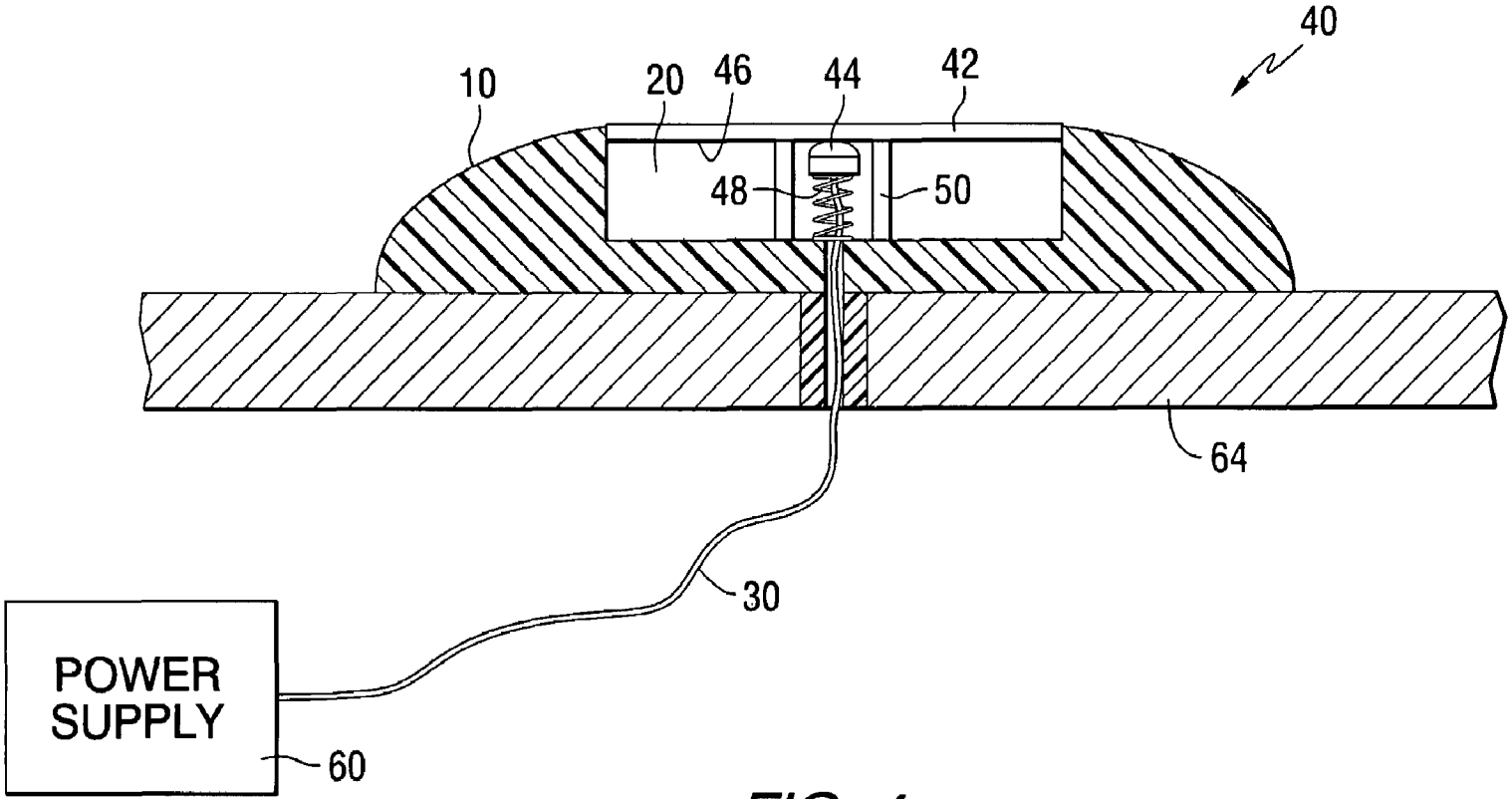
FIG. 4 is a section view of the present invention attached to a transom of a marine vessel.

FIG. 4 shows an anode 40 made in conjunction with a preferred embodiment of the present invention. The cavity 20 serves the basic purpose of the cavity described above in conjunction with FIGS. 1–3, although certain modifications are possible in a preferred embodiment of the present invention. An element 42 is made of a polymer matrix having an electrically conductive filler. This element 42 replaces the platinum-coated titanium element 12 described above. The element 42 is a conductive plastic material that is highly resistant to corrosion and chemical attack while also being highly conductive, both electrically and thermally. This material is generally similar to the material discussed in U.S. Pat. Nos. 6,251,308 and 6,365,069 described above.

With continued reference to FIG. 4, a contact element 44 is urged toward the underside 46 of the insert 42 by a spring 48. An electrical conductor, 30 is connected in electrical communication with the contact element 44. The cavity 20 below the insert 42 can be filled with encapsulant, such as the encapsulant 39 described above in conjunction with FIG. 3. This encapsulant inhibits the intrusion of water into the space under the insert 42 and in the region of the contact element 44 and spring 48. In some embodiments of the present invention, a dam 50 can be provided to isolate the spring 48 and contact element 44 from the encapsulant which is inserted into the remaining portions of the cavity 20. The electrical conductor 30 allows a power supply 60 to be connected in electrical communication with the contact element 44 and, in turn, with the insert 42 because of the intimate contact between the contact element 44 and the underside 46 of the insert 42.

In FIG. 4, the base 10 is shown attached to a transom 64 of a marine vessel. It should be understood that although the transom 64 is shown in a generally horizontal position in FIG. 4, it is typically disposed in a near vertical configuration at the rear of a marine vessel.

With continued reference to FIG. 4, the present invention provides a support structure, such as the base 10, and a conductive element, such as the insert 42, that comprises a polymer matrix material with conductive particles supported within the polymer matrix material. The matrix material is typically a polymer such as vinyl ester and the conductive particles are typically a graphite filler or powder supported within the vinyl ester material. The present invention further comprises a conductor 30 that is connected in electrical communication with the conductive element 42 which allows the conductor 30 to be connected in electrical communication between a power supply 60 and the conductive element 42. In the embodiment shown in FIG. 4, the contact element 44 provides the intimate electrical contact between the conductor 30 and the conductive element 42.

As described above, the conductive element 42 comprises a matrix of vinyl ester with graphite particles disposed within the matrix. The support structure, or base 10, is attachable to a component, such as the transom 64, of a marine vessel. The support structure is made of polymer in a preferred embodiment of the present invention and the encapsulant which is disposed in the cavity 20 prevents moisture from contacting the conductor 30 within the space of the cavity 20.

Although the present invention has been described to show a particular embodiment and illustrated with specific detail, it should be understood that alternative embodiments are also within its scope.

We claim:

1. A submersible anode, comprising:

a support structure;

a conductive element comprising a matrix material and conductive particles supported within said matrix material; and a conductor connected in electrical communication with said conductive element, said conductor being connectable to an electrical power supply, wherein said support structure comprises a base attached to a component of a marine vessel and protruding outwardly therefrom, said conductive element is supported by said base and has a first face facing outwardly, and a second face facing inwardly, and said conductor is connected to said second face.

2. The submersible anode according to claim 1 wherein said base has an outer periphery and a cavity recessed inwardly therefrom, said cavity having an outer reach at said outer periphery of said base, said cavity having an inner reach spaced inwardly of said outer reach, said conductive element being supported in said cavity outwardly of said inner reach.

3. The submersible anode according to claim 2 comprising a sealing encapsulant in said cavity and in contact with said conductive element and blocking moisture from contacting said conductor.

4. The submersible anode according to claim 3 wherein said encapsulant is between said conductive element and said inner reach, said conductive element being spaced outwardly of said inner reach by said encapsulant therebetween.

5. The submersible anode according to claim 4 wherein said conductive element is at said outer reach along said outer periphery of said base.

6. The submersible anode according to claim 4 comprising a dam in said cavity isolating the connection of said conductor and said second face of said conductive element from said encapsulant.

7. The submersible anode according to claim 1 wherein said conductor engages said second face of said conductive element with a spring loaded contact.

8. The submersible anode according to claim 1 wherein said base has a hole receiving said conductor therethrough for connection to said second face of said conductive element.

9. The submersible anode according to claim 8 wherein said component of said marine vessel has a second hole receiving said conductor therethrough such that said conductor extends through each of said component of said marine vessel and said base through respective said holes.

10. The submersible anode according to claim 1 wherein said base has an outer periphery and a cavity recessed inwardly therefrom, said cavity having an outer reach at said outer periphery of said base, said cavity having an inner reach spaced inwardly of said outer reach, said conductive element being supported in said cavity outwardly of said inner reach, said base has a first hole communicating with said cavity and receiving said conductor extending through said first hole into said cavity for connection to said second face of said conductive element, said component of said marine vessel has a second hole aligned with said first hole and receiving said conductor therethrough, such that said conductor extends through each of said first and second aligned holes into said cavity.

11. The submersible anode according to claim 1 wherein each of said base and said conductive element is a polymer material.

12. The submersible anode according to claim 1 wherein said component of said marine vessel is a transom of said marine vessel.

* * * * *